US005287924A

United States Patent [19]

Burleson et al.

[11] Patent Number: 5,287,924

[45] Date of Patent: Feb. 22, 1994

[54] TUBING CONVEYED SELECTIVE FIRED PERFORATING SYSTEMS

[75] Inventors: John D. Burleson; Justin L. Mason, both of Denton; Flint R. George, Flower Mound, all of Tex.

[73] Assignee: Halliburton Company, Duncan, Okla.

[21] Appl. No.: 937,601

[22] Filed: Aug. 28, 1992

[51] Int. Cl.[5] ..... E21B 29/02

[52] U.S. Cl. ..... 166/297; 166/55; 166/63

[58] Field of Search ..... 166/55, 55.1, 296, 297, 166/299, 63

[56] References Cited

U.S. PATENT DOCUMENTS

| | | | |
|---|---|---|---|
| 3,717,095 | 2/1973 | Vann | 102/21.6 |
| 3,830,299 | 8/1974 | Thomeer | 166/297 X |
| 4,496,010 | 1/1985 | Chapman, III | 175/4.55 |
| 4,612,992 | 9/1986 | Vann et al. | 166/297 |
| 4,619,333 | 10/1986 | George | 166/297 |
| 4,823,875 | 4/1989 | Hill | 166/297 X |
| 4,901,802 | 2/1990 | George et al. | 166/297 |
| 4,938,286 | 7/1990 | Jennings, Jr. | 166/297 X |
| 4,969,525 | 11/1990 | George et al. | 166/297 |
| 5,078,210 | 1/1992 | George | 166/55 |
| 5,103,912 | 4/1992 | Flint | 166/55 |
| 5,115,865 | 5/1992 | Carisella et al. | 166/297 |
| 5,161,616 | 11/1992 | Colla | 166/297 |

OTHER PUBLICATIONS

Exhibit A-Undated advertising brochure admitted to be prior art illustrating the Vann Systems Time Delayed Firing Head.

Exhibit B-Undated brochure admitted to be prior art illustrating a Vann Systems Differential Firing Head.

Exhibit A-Catalog pp. 22-37 from a Gearhart Company catalog.

*Primary Examiner*—Ramon S. Britts
*Assistant Examiner*—Frank S. Tsay
*Attorney, Agent, or Firm*—Tracy W. Druce; Lucian Wayne Beavers

[57] ABSTRACT

A system is provided for selectively perforating multiple zones in a well on a single trip into the well. The system includes a tubing string which carries at least a first and a second perforating gun. At least a first and a second pressure actuated firing head are associated with the first and second perforating guns, respectively. A source of actuating fluid pressure for the firing head is provided, which may be the bore of the tubing string. A first selective communication device is provided for isolating the second firing head from the source of actuating fluid pressure until after the first perforating gun has been fired, and for then communicating the second firing head with the source of actuating fluid pressure in response to firing of the first perforating gun. The first firing head provides a time delay during which the actuating fluid pressure may be bled off prior to the firing of the first perforating gun.

27 Claims, 4 Drawing Sheets

TUBING CONVEYED SELECTIVE FIRED PERFORATING SYSTEMS

BACKGRUOND OF THE INVENTION

1. Field Of The Invention

The present invention relates to the field of well perforating.

2. Description Of The Prior Art

During the completion of an oil or gas well, a length of casing is cemented in a borehole, and then one or more zones of the casing are perforated to communicate the bore of the casing with subsurface geological formations intersected by the borehole so that oil or gas from that subsurface formation may be produced by the well.

One well-known type of perforating system is a tubing conveyed perforating system wherein the perforating guns and related apparatus are carried by a tubing string made up of a plurality of threaded joints of tubing or pipe which are connected together and lowered into the well. These tubing conveyed completion systems may be run in combination with a drill stem test string so that the well can be perforated and tested in a single trip.

In some situations, it is desirable to be able to selectively perforate more than one zone of the well at different times. The prior art has typically addressed this need by the provision of multiple firing heads which are constructed to actuate at different operating pressures. With these systems, the selection of the appropriate firing head and gun to be fired is determined by the pressure which is applied to the tubing string or the well annulus to actuate the firing head. Systems of this type capable of firing several perforating guns independently during one trip into the well can be constructed utilizing the Time Delayed Firing Head available from Vann Systems of Carrollton, Texas. The Vann Time Delayed Firing Head utilizes a set of shear pins the number of which can be selected to determine the actuating pressure of each firing head.

SUMMARY OF THE INVENTION

The present invention provides a tubing conveyed selective fired perforating system for selectively perforating multiple zones of a well during a single trip into the well.

The system includes a tubing string carrying at least a first and a second perforating gun. At least a first and a second pressure actuated firing head are associated with the first and second perforating guns, respectively.

A source of actuating fluid pressure for the firing heads is provided. The source is preferably either the tubing bore of the tubing string or the well annulus surrounding the tubing string.

A first selective communication means is provided for isolating the second firing head from the source of actuating fluid pressure until after the first perforating gun has been fired, and for then communicating the second firing head with the source of actuating fluid pressure in response to firing of the first perforating gun.

Additional selective communication means can be provided to allow for firing of additional perforating guns selectively in sequence.

The selective communication means preferably is a select fire sub including a housing having a first chamber defined therein. The first chamber is communicated with the second firing head. A supply passage is communicated with the source of actuating fluid pressure and extends into the housing. The supply passage is initially isolated from the first chamber. An explosive means is contained in a second chamber of the housing for perforating a portion of the housing and thereby communicating the supply passage with the first chamber. An actuating means fires the explosive means of the select fire sub in response to firing of the first perforating gun.

Numerous objects, features and advantages of the present invention will be readily apparent to those skilled in the art upon a reading of the following disclosure when taken in conjunction with the accompanying drawings.

Figure 8:
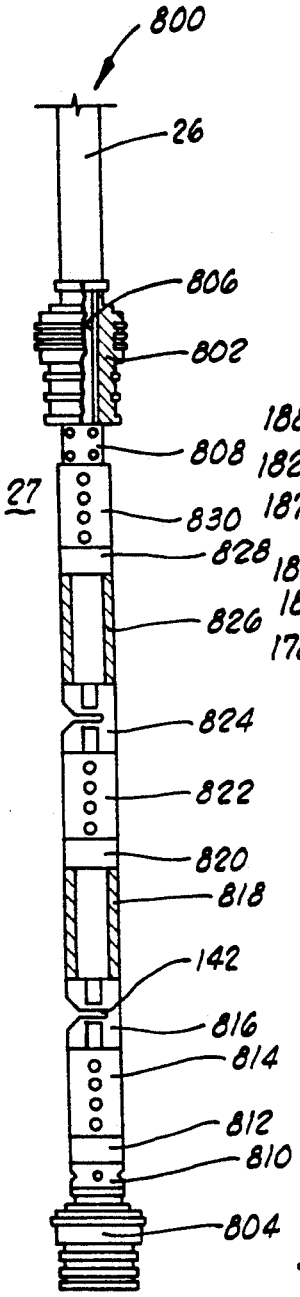

FIG. 8 is an elevation schematic view of a sixth version of the tubing conveyed selective fired perforating system of the present invention. The system of FIG. 8 also carries both a retrievable packer and a retrievable bridge plug. It is constructed so that actuating fluid pressure is conveyed down the tubing string and then crossed over into the well annulus surrounding the perforating guns and select fire subs. The series of perforating guns and select fire subs are arranged so that the perforating guns are selectively fired sequentially from the bottom up. Due to the presence of both a packer and bridge plug which allows isolation of the perforated zone, the zone may then be flow tested after it is perforated.

Figure 2:
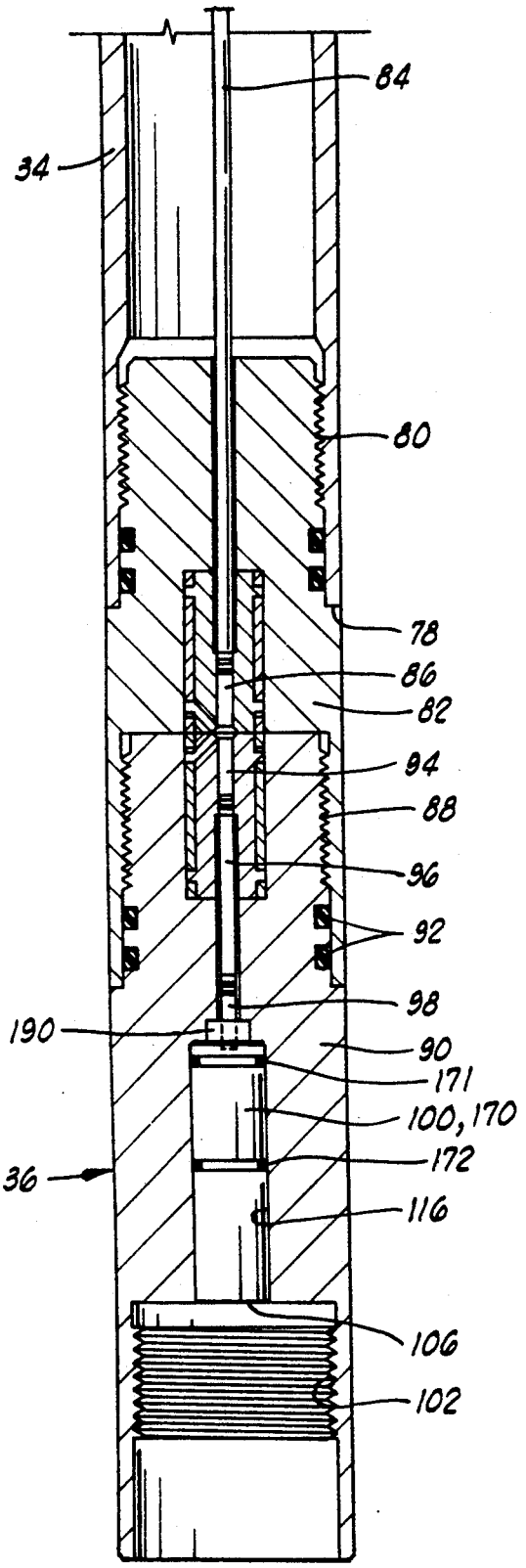
FIG. 2 is an elevation sectioned view showing the details of construction of an isolation sub assembly utilized in the system of FIG. 1. The isolation sub is shown connected to the lower end of a perforating gun.
Figure 9:
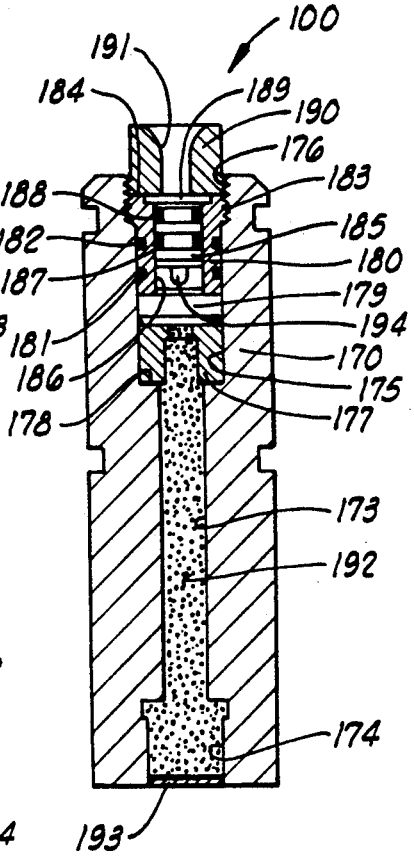

FIG. 9 is an enlarged sectioned view of the gun delay/isolation device used in the isolation sub of FIG. 2.

DETAILED DESCRIPTION OF THE PREFERRED EMBODIMENTS

Figure 1:
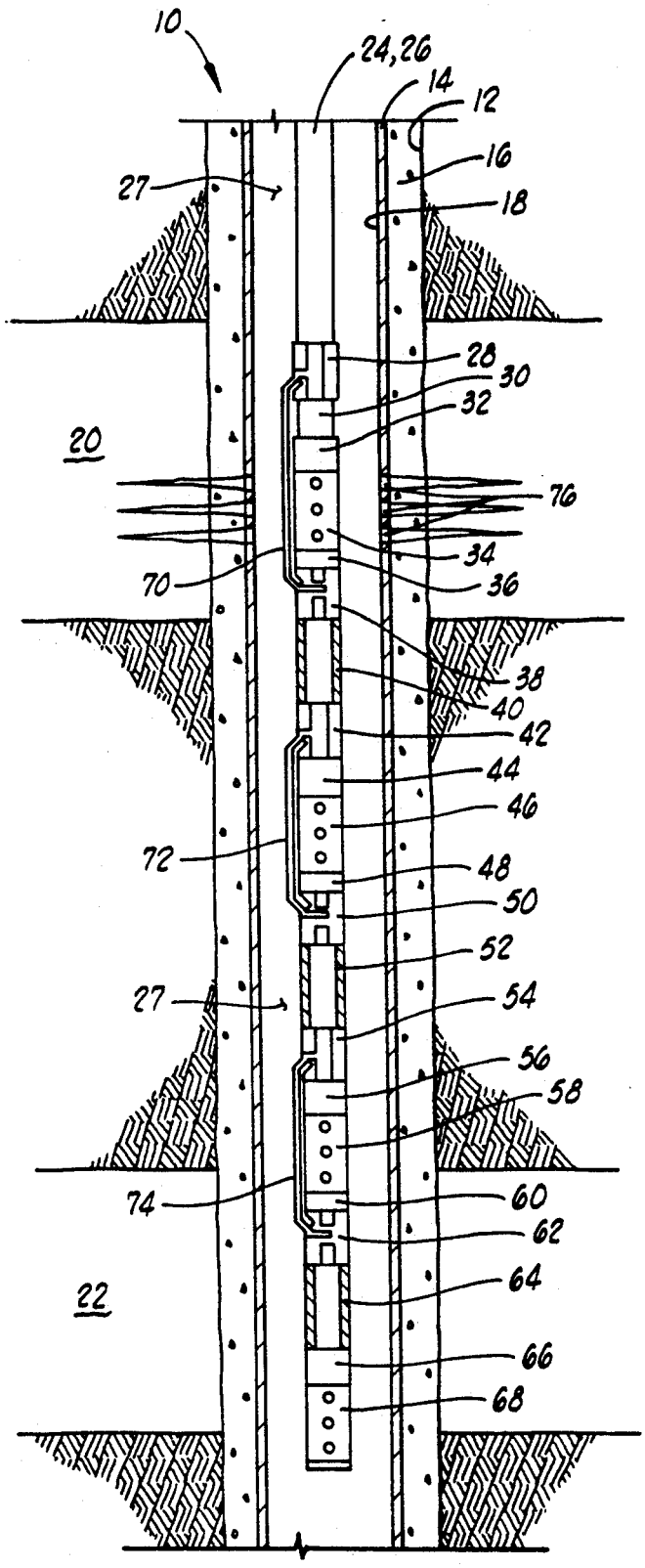
FIG. 1 is an elevation schematic view of a first embodiment of the tubing conveyed selective fired perforating system of the present invention shown in place in a well which intersects a plurality of subsurface geological formations which are to be perforated. The system of FIG. 1 is constructed to operate without a packer and to fire the plurality of perforating guns selectively in sequence from the top down. The system of FIG. 1 is arranged to be actuated by fluid pressure conveyed down the tubing string and the communicated through external control fluid conduits to the series of select fire subs.

Turning now to the drawings, and particularly to FIG. 1, a well is shown and generally designated by the numeral 10. The well 10 is formed by drilling a borehole 12 into the ground and then placing a casing 14 within the borehole 12 and cementing the casing in place with cement 16. The casing 14 has a casing bore i. The borehole 12 intersects one or more subsurface geological formations such as 20 and 22 which are to be perforated for testing and/or production of the well from those zones.

A perforating string 24 is shown in place in the well 10. The perforating string 24 of the present invention may also be referred to as a tubing conveyed selective fired perforating system 24. A well annulus 27 is defined between the casing bore 18 and the perforating string 24.

The system 24 provides a means by which a plurality of perforating guns can be selectively fired so as to selectively perforate multiple zones of the well 10 such as the zones 20 and 22 illustrated in FIG. 1.

The system 24 includes a tubing string 26 which carries on its lower end a string of tools which beginning from top to bottom include a tubing annulus crossover sub 28, a tubing spacer sub 30, a first pressure actuating firing head 32, a first perforating gun 34, a first isolation sub 36, a first select fire sub 38, a first air chamber 40, a first control line sub 42, a second pressure actuated firing head 44, a second perforating gun 46, a second isolation sub 48, a second select fire sub 50, a second air chamber 52, a second control line sub 54, a third pressure actuated firing head 56, a third perforating gun 58, a third isolation sub 60, a third select fire sub 62, a third air chamber 64, a fourth pressure actuated firing head 66, and a fourth perforating gun 68.

It will be understood that each of the perforating guns schematically illustrated in FIG. 1 may be made up of many individual gun segments connected together in series to provide the proper length of gun to perforate the zone in question.

The tubing annulus crossover sub 28 is communicated with the first select fire sub 38 by a first control fluid conduit portion 70. The conduit 70 may be ¼" O.D. stainless steel tubing. The first control line sub 42 is communicated to the second select fire sub 50 by a second control fluid conduit portion 72. The second control line sub 54 is communicated to the third select fire sub 62 by a third control fluid conduit portion 74.

The system 24 is constructed for use without a packer and is arranged to fire the perforating guns 34, 46, 58 and 68 selectively in sequence from the top down. That is, the first gun to fire will be first gun 34. The next gun to fire will be second gun 46 and so forth.

To selectively perforate multiple zones such as zones 20 and 22 of the well 10 with the system 24 the procedure is carried out as follows. The system 24 is lowered into the casing bore 18 of well 1 until the first perforating gun 34 is located adjacent the first subsurface zone 20 which is to be perforated.

Actuating fluid pressure to actuate the firing heads associated with each of the perforating guns is provided through the bore of the tubing string 26 which may be generally described as a source 26 of actuating fluid pressure for the firing heads such as 32, 44, 56 and 66.

This actuating fluid pressure is communicated through the tubing annulus crossover sub 28 to both the first control fluid conduit portion 70 and through the tubing spacer sub 30 to the first pressure actuated firing head 32.

Figure 3:
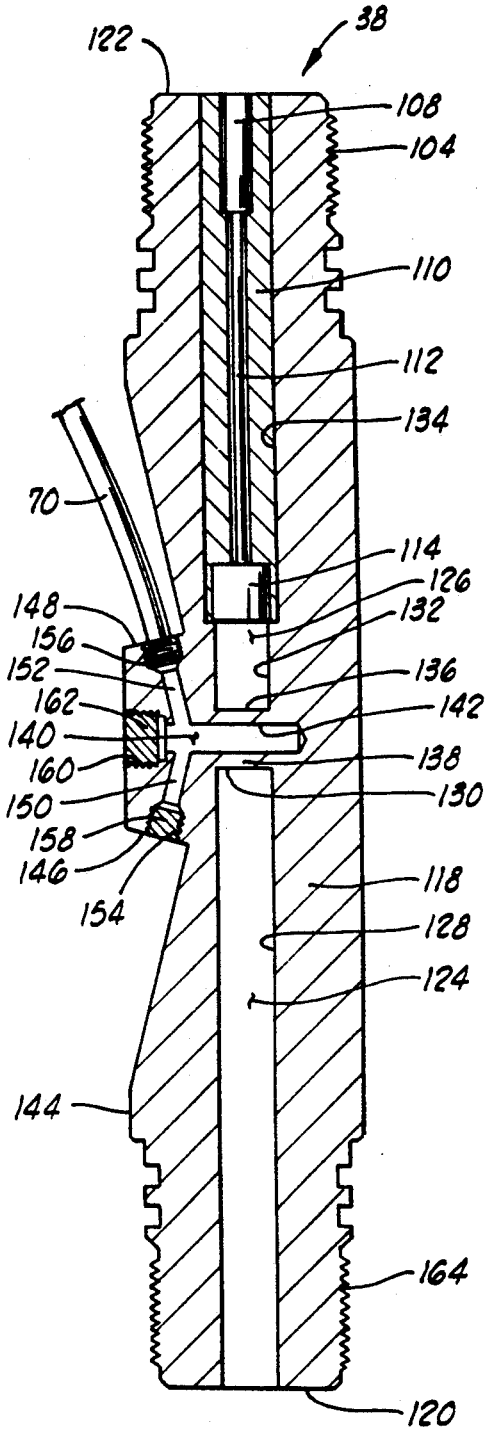
FIG. 3 is an elevation sectioned view showing the details of construction of a select fire sub utilized with the system of FIG. 1.

As is further described below with regard to the detailed drawing of FIG. 3 illustrating the select fire sub 38, the pressure contained in first control fluid conduit portion 70 is initially isolated from the firing heads located therebelow.

The firing heads 32, 44, 56 and 66 preferably are Time Delay Firing Heads available from Vann Systems of Carrollton, Texas. These firing heads employ a time delay fuse. The use of the time delay fuse allows for ample time, on the order of five to seven minutes, to bleed the actuating pressure off the tubing string 26 prior to the time the associated perforating gun fires. The operating pressure of the firing head 32 is determined by selection of the number of shear pins utilized to hold a firing piston in place initially against the differential pressures acting thereacross.

The pressure in tubing string 26 is raised to the actuating pressure necessary to actuate the first firing head 32. When the first firing head 32 is actuated, the pressure in the tubing string 26 is bled off before the firing head 32 actually fires the perforating gun 34. As is further explained below, it is necessary to bleed off the actuating pressure before the first gun 34 fires, or the second firing head 44 would be actuated as soon as the first select fire sub 38 was detonated. After the time delay determined by the construction of the firing head 32, the first firing head 32 fires the first perforating gun 34 which creates a plurality of perforations such as 76 extending through the casing 14 and communicating the casing bore 18 with the first subsurface geological formation 20.

When the first perforating gun 34 fires, it detonates the first isolation sub 36, the details of construction of which are shown in FIG. 2.

As seen in FIG. 2, a lower end 78 of first perforating gun 34 is threadedly connected at 80 to a crossover sub 82. A detonating cord 84 extends from the lower end of perforating gun 34 through the crossover sub 82 where it terminates in a booster charge 86. The crossover sub 82 and components contained therein may be considered to be a portion of the first perforating gun 34.

The crossover sub 82 is connected at thread 88 to a delay housing 90 of isolation sub 36 with O-ring seals 92 being provided therebetween.

The delay housing 90 carries a booster charge 94 at its upper end which is fired by the booster charge 86. The booster charge 94 in turn ignites a length of detonating cord 96 which leads to a third booster charge 98 which fires a gun delay/isolation device 100.

The lower end portion of delay housing 90 has internal threads 102 which are joined to external threads 104 of the select fire sub 38 seen in FIG. 3, so that a lower end 106 of gun delay/isolation device 100 abuts a booster charge 1 received in the first select fire sub 38 The booster 108 is contained in a cylindrical insert 110 which carries the booster 108, a length of detonating cord 112, and a shaped charge 114.

The gun delay/isolation device 100 when fired by the booster 98 will in turn fire the booster 108, but at the same time will prevent fluid communication through a bore 116 of delay housing 90 thereby maintaining the first perforating gun 34 isolated from the select fire sub 38. The gun delay/isolation device 100 works in the following manner.

FIG. 9 is an enlarged sectioned view of the gun delay/isolation device 100. Device 100 includes a housing 170 received in bore 116 with O-ring seals 171 and 172 received therebetween. Housing 170 has a bore 173, lower counterbore 174, upper counterbore 175, and upper threaded counterbore 176 defining a central passage therethrough.

Upper counterbore 175 has an annular spacer 177 received therein abutting shoulder 178. Located above spacer 177 is a primer cap 179.

Located above primer cap 179 is a piston sleeve 180 carrying O-rings 181 and 182 which seal against counterbore 175. Piston sleeve 180 is threaded at 183 adjacent its upper end 184. Thread 183 is received in threaded counterbore 176 to hold piston sleeve 180 in place.

A piston 185 is received in a bore 186 of piston sleeve 180 with two O-rings 187 and 188 therebetween. Piston 185 has a radially outward extending flange 189 at its upper end which is larger in diameter than bore 186 and initially holds piston 185 in the position shown.

An annular retainer ring 190 is threadedly received in threaded counterbore 176 above piston 185 to prevent upward movement of piston 185.

Retainer ring 190 has booster 98 (see FIG. 2) received in a bore 191 thereof.

Below primer cap 179 the bore of spacer 177 and the bore 173 and counterbore 174 of housing 170 are packed with an explosive mixture 192 which is held in place by a thin retainer disc 193 received in the lower end of lower counterbore 174.

When booster 98 detonates, the high pressure generated thereby pushes down on piston 185 shearing the radial flange 189. Piston 185 travels downward within bore 186 a short distance until firing pin 194 of piston 185 strikes primer cap 179 detonating the same. The detonation of primer cap 179 detonates the explosive material 192 which will rupture disc 193 and in turn detonate booster 108 (see FIG. 3). The burning of explosive mixture 192 will also provide a short time delay in this explosive chain reaction.

The piston 185 remains sealed in bore 186 of piston sleeve 10, thereby preventing any fluid pressure communication through the device 100.

The device 100 is itself a part of the prior art and is constructed in accordance with the teachings of U.S. Pat. No. 5,078,210 to George, the details of which are incorporated herein by reference.

The select fire sub 38 is shown in detail in FIG. 3. Select fire sub 38 includes a cylindrical housing 118 which can be described as having first and second ends 120 and 122 Which may also be referred to as lower and upper ends 120 and 122 in the orientation shown in FIG. 3. As will become apparent when viewing the various alternative systems shown in FIGS. 4–8, the orientation of the select fire sub may be inverted.

The housing 118 of select fire sub 38 has first and second axially extending chambers 124 and 126 defined therein and communicated with the first and second ends 120 and 122, respectively, of housing 118. The first chamber 124 is defined by a bore 128 which has a blind end 130. The second chamber 126 is defined by a bore 132 and a counterbore 134. The bore 132 has a blind end 136.

The blind ends 130 and 136 of chambers 124 and 126 are separated by a wall 138 of housing 118.

The housing 118 has an actuating pressure supply passage 140 defined therein. Supply passage 140 includes a lateral bore 142 extending laterally into the wall 138 between the blind ends 130 and 136 of first and second chambers 124 and 126.

Housing 118 includes a cylindrical outer surface 144 having first and second recesses 146 and 148 defined therein on opposite sides longitudinally of the lateral bore 142.

The actuating pressure supply passage 140 further includes first and second branch passages 150 and 152 communicating the lateral bore 142 with the first and second recesses 146 and 148, respectively. Each of the branch passages 150 and 152 includes an internally threaded outermost portion such as 154 and 156 which provides a means for connection thereof to a control fluid conduit such as control fluid conduit portion 70 which extends into the first recess 148.

It is noted that for the first select fire sub 38 of FIG. 1 which is shown in detail in FIG. 3, the threaded outer end 154 of first branch passage 150 is blocked by a threaded plug 158. Also, a threaded outer portion 160 of lateral bore 142 is blocked by a threaded plug 162.

The lower portion of select fire sub 38 carries external threads 164 which are connected to the first air chamber 40 seen in FIG. 1.

As previously described, when the first perforating gun 34 fires, it in turn detonates the first gun delay/isolation device 100 which in turn detonates the first select fire sub 38 by detonating booster 108 which ignites detonating cord 112 which then fires the shaped charge 114. The shaped charge 114 creates a downwardly directed explosive jet which will chambers 124 and 126 with each other and with the lateral bore 142 of actuating pressure supply passage 140. Thus, when the shaped charge 114 perforates wall 138, it communicates the first chamber 124 with the actuating pressure supply passage 140 and thus with the source of actuating fluid pressure contained in the tubing string 26.

This pressure is communicated down through the first chamber 124 and through the first air chamber 40 to the first control line sub 42 seen in FIG. 1. First control line sub 42 communicates the pressure both to the second control fluid conduit portion 72 and to the second pressure actuated firing head 44.

The system 24 is now ready for firing of the second perforating gun 46 when the actuating pressure in tubing string 26 is next raised to a sufficient level.

It will be apparent that if the actuating fluid pressure were not bled off prior to firing of first gun 34, the second firing head 44 would be immediately actuated upon detonation of the first select fire sub 38.

The select fire sub 38 can generally be described as a selective communication means 38 for isolating the second firing head 44 from the source of actuating fluid pressure in tubing string 26 until after the first perforating gun 34 has been fired. After the first perforating gun 34 has been fired, the select fire sub 38 which has in turn been detonated by first perforating gun 34, provides a means for communicating the second firing head 44 with the source of actuating fluid pressure in tubing string 26 in response to the firing of the first perforating gun 34.

The shaped charge 114 can be generally described as an explosive means 114 for perforating a portion of the housing 118, namely the wall 138, and thereby communicating the supply passage 140 with the first chamber 124.

The explosive train contained in the isolation sub 36, namely the detonating cord 84, boosters 86 and 94, detonating cord 96, booster 98 and the gun delay/isolation device 100 can be generally described as an actuating means for firing the shaped charge 114 of select fire sub 38 in response to firing of the first perforating gun 34. The gun delay/isolation device 100 can also be described as an isolation means 100 for isolating the first perforating gun 34 from the first chamber 124 of the select fire sub 38 after the shaped charge 114 of select fire sub 38 is fired thus perforating the wall 138.

The various passages throughout the tool string shown in FIG. 1 which communicate the various tools with the source of actuating fluid pressure in tubing string 26, such as the control fluid conduit portion 70, 72 and 74 may each be considered to be a part of the source of actuating fluid pressure.

Typically it will be desired to move the perforating string 24 before firing the second gun 72. For example, in the situation illustrated in FIG. after the first perforating gun 34 has been fired to perforate the first zone 20, the tubing string 26 will be lowered until the second perforating gun 46 is adjacent the second zone 22 which is to be perforated. The source of actuating fluid pressure in tubing string 26 is now in communication with the second pressure actuated firing head 44.

After the second perforating gun 46 has been located adjacent the second subsurface formation 22, the pressure in tubing string 26 is again raised to an appropriate level to actuate the second firing head 44. Then pressure is bled off prior to the time that the second firing head 44 actually fires the second perforating gun 46.

It is noted that with the system of the present invention, each of the firing heads can be actuated at the same pressure. This is contrasted to prior art systems wherein each successive firing head had to be actuated at a higher pressure. Thus the system of the present invention can be operated at lower actuating pressures than those required by prior art systems.

When the second perforating gun 46 fires, the process described above repeats, that is the second perforating gun will detonate the second isolation device 48 which in turn will detonate the second select fire sub 50 which in turn will place the tubing string 26 in communication with the third firing head 56 and the third control fluid conduit portion 74.

The next time tubing pressure is raised to an appropriate level, the third firing head 56 will be actuated which will in turn fire third perforating gun 58 which will in turn fire third isolation device 60 which will detonate the third select fire sub 62 thus placing the system in condition for subsequent firing of the fourth perforating gun 68 as desired.

When it is desired to fire the fourth perforating gun 68, actuating pressure is again applied to the tubing string 26 and communicated through third control fluid conduit portion 74, third select fire sub 62, and third air chamber 64 to the fourth pressure actuating firing head 66 which will in turn fire the fourth perforating gun 68.

It will be appreciated that any number of perforating guns can be selectively fired with the system described herein by providing additional isolation subs and select fire subs and other related components as required.

It will be apparent that in general the system 24 will have one less select fire sub than it has perforating guns. For example, the system of FIG. 1 has four perforating guns and has three select fire subs. The system can be generally described as having a total number X of perforating guns and having a total number X−1 of select fire subs.

As is apparent from the description just given for the system of FIG. 1, in that system, the first perforating gun 34 is located above the second perforating gun 46 so that the system 24 fires the perforating gun sequentially from the top down.

THE ALTERNATIVE EMBODIMENT OF FIG. 4

Figure 4:
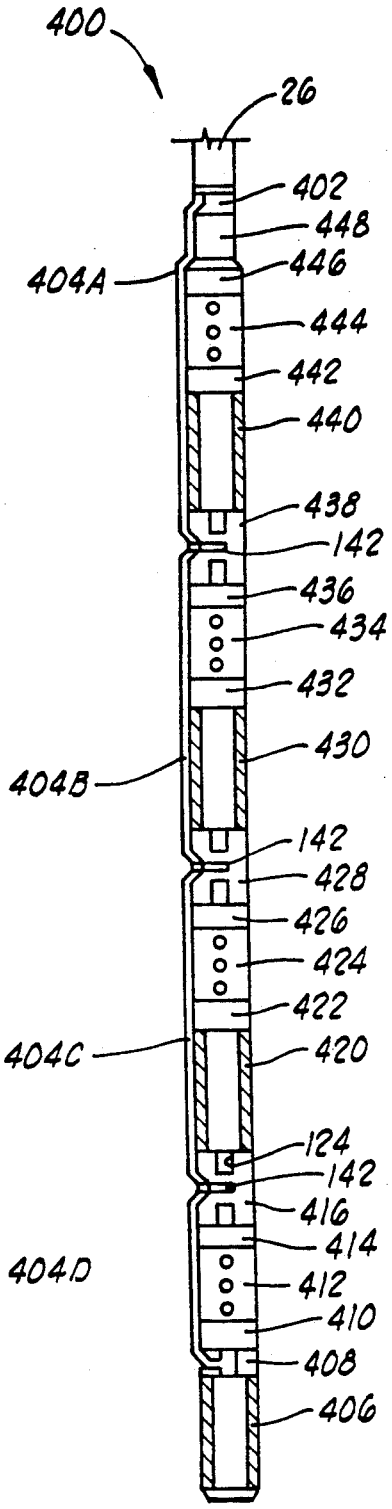
FIG. 4 is an elevation schematic view similar to FIG. 1, but eliminating the details of the surrounding well structure, showing a second version of the tubing conveyed selective fired perforating system of the present invention. The system of FIG. 4 is constructed to operate without a packer, and to selectively fire the plurality of perforating guns in sequence from the bottom up. The system of FIG. 4 is constructed to be actuated by fluid pressure conveyed down the tubing bore and then communicated to the series of select fire subs through control fluid conduits located externally of the subs.

FIG. 4 illustrates an alternative version of the perforating system of the present invention which is shown and generally designated by the numeral 400. The system 40 of FIG. 4 is very similar to the system 24 of FIG. 10, but the components have been somewhat rearranged so that the perforating guns of the perforating string 400 in FIG. 4 fire from bottom up rather than from the top down. The perforating string 400 of FIG. 4, like the system 24 of FIG. 1, is designed for use without a packer and it utilizes the tubing string 26 as a source of actuating fluid pressure.

For ease of illustration in FIGS. 4 and the following figures, the various components of the well surrounding the perforating string have been eliminated. It will be understood that these alternative versions of the perforating string of the present invention are utilized in the same general context as illustrated in FIG. 1.

In FIG. 4, the perforating system 400 includes the tubing string 26 previously mentioned, and a control line sub 402 connected to the tubing string 26. The control line sub 402 provides for connection of a control fluid conduit 404 made up of conduit portions 404A, 404B, 404C and 404D to the inner bore of tubing string 26. As seen in FIG. 4, the control fluid conduit 404 extends alongside the entire string of perforating guns and related devices.

Since the system 400 fires from bottom up, the various components making up that perforating string will be described beginning at the bottom with a first air chamber or fluid chamber 406. Located above first air chamber 406 is a lower control line sub 408 to which the lower end of control fluid conduit 404 is connected.

Lower control line sub 408 provides actuating fluid pressure to a first pressure actuated firing head 410 which after an appropriate time delay will fire a first perforating gun 412.

Located above first perforating gun 412 is a first isolation sub 414 and a first select fire sub 416. The first isolation sub 414 is constructed in a manner similar to the isolation sub 36 of FIG. 2 except that it is inverted as compared to the drawing of FIG. 2.

First select fire sub 416 is similar to the first select fire sub 38 of FIG. 3 with two modifications. The first change is that the first select fire sub 416 is inverted, that is turned upside down relative to the drawing of FIG. 3 so that the shaped charge 114 will be contained in the lowermost chamber of the first select fire sub 416 and will be directed upwardly to perforate the wall 138. The second change is in the manner in which the control fluid conduit 404 is connected to the first select fire sub 416. The control fluid conduit portions 404C and 404D are connected to threaded ends 154 and 156 of branch passages 150 and 152. Plug 162 is still in place in lateral bore 142.

Thus, when it is desired to fire the first perforating gun 412, actuating fluid pressure in tubing string 26 will be increased and communicated through control fluid conduit 404 and through the lower control line sub 408 to first firing head 410 to actuate the same. Actuating fluid pressure will then be bled off during the time delay provided by firing head 410. When the first perforating gun 412 fires, it will detonate the isolation sub 414 which will in turn detonate the first select fire sub 416 thus perforating the wall 138 of first select fire sub 416 and placing the lateral bore 142 of first select fire sub 416 in communication with its upper chamber 124. The perforating string 400 will now be in condition for the firing of the next perforating gun.

The remaining components of first perforating string 400 include a second air chamber 420, a second pressure actuated firing head 422, a second perforating gun 424, a second isolation sub 426, a second select fire sub 428, a third air chamber 430, a third pressure actuated firing head 432, a third perforating gun 434, a third isolation sub 436, a third select fire sub 438, a fourth air chamber 440, a fourth pressure actuated firing head 442, and a fourth perforating gun 444. Located above the fourth perforating gun 444 is a gun-tubing crossover sub 446 and above that is a spacer sub 448 which is connected to the upper control line sub 402.

The second and third select fire subs 428 and 438 have their branch passages 150 and 152 communicated with control fluid conduit portions 404 like described above for sub 416.

When actuating pressure is applied to tubing string 26, a second time to fire the second perforating gun 424, the first isolation device 414 prevents that fluid pressure from entering the already fired first perforating gun 412. The actuating pressure will be bled off. The second gun 424 will fire thus detonating the second isolation sub 426 and second select fire sub 428. The system is then ready for firing of the third gun, 434, and so on.

Thus, the system 400 provides a system which selectively fires a plurality of perforating guns sequentially from the bottom up.

THE EMBODIMENT OF FIG. 5

Figure 5:
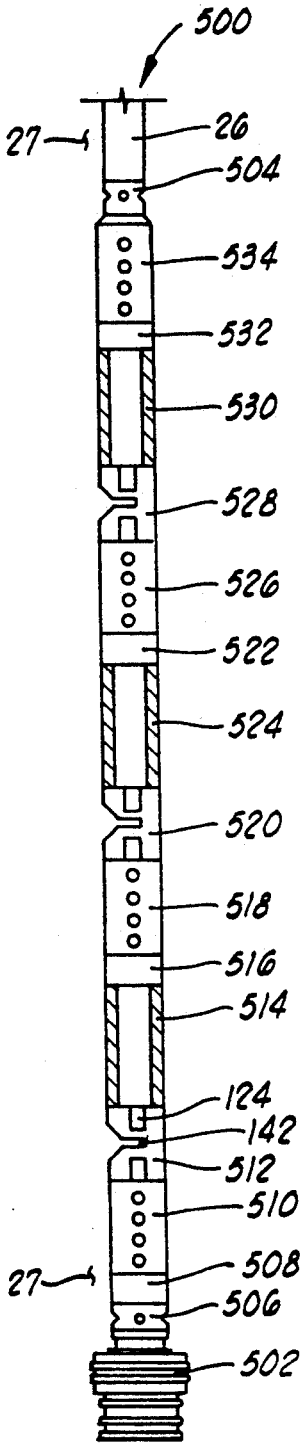
FIG. 5 is a schematic elevation view of a third version of the tubing conveyed selective fired perforating system of the present invention. The plurality of perforating guns are arranged to be selectively fired in sequence from the bottom up. A bridge plug is carried on the lower end of the tool string. The system of FIG. 5 is arranged to be actuated by fluid pressure from the tubing string which is communicated with the well annulus surrounding the perforating guns and select fire subs.
Figure 6:
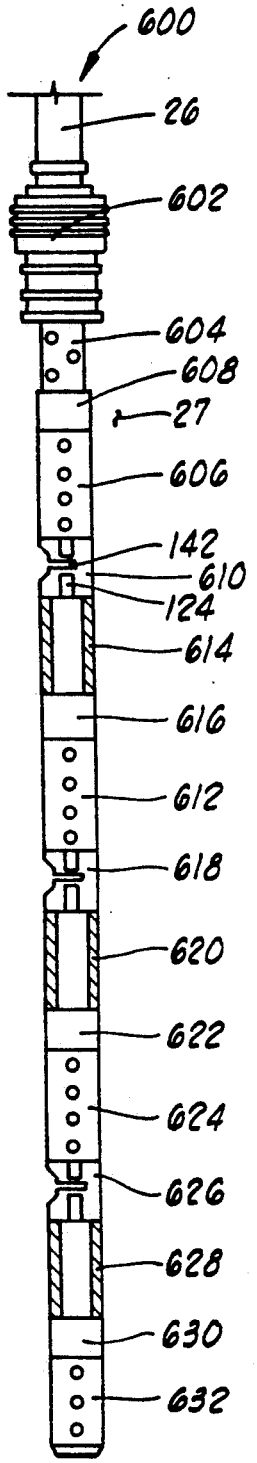
FIG. 6 is an elevation schematic view of a fourth version of the tubing conveyed selective fired perforating system of the present invention. The system of FIG. 6 is constructed to be actuated with tubing pressure which is communicated to a well annulus surrounding the perforating guns and select fire subs. The system of FIG. 6 carries a packer, and the series of guns are fired from the top down.

FIG. 5 shows another version of the perforating string of the present invention which is shown and generally designated by the numeral 500. The system 500 again includes the tubing string 26 which has a plurality of perforating guns and related equipment carried thereon. The system 500 of FIG. 6 is designed to utilize a retrievable bridge 502 on the bottom thereof.

The system 500 is also modified in that although it uses the tubing string 26 as a source of actuating fluid pressure, that pressure is communicated to the various select fire subs through the well annulus 27 (see FIG. 1) which surrounds those select fire subs. This is accomplished with a perforated sub 504 connected to the lower end of tubing string 26 and communicating the bore of tubing string 26 with the surrounding well annulus 27. The perforating string 500 of FIG. 5 is designed to fire its various perforating guns from the bottom up, and thus will be described beginning from the bottom with the retrievable bridge plug 502. Located above the retrievable bridge plug 502 is a lower perforated sub 506 which communicates the surrounding well annulus 27 with the first pressure actuated firing head 508.

With reference to the plurality of zones 20 and 22 shown in FIG. 1, the system 500 would be utilized to perforate those zones preferably beginning with the lowermost zone. For example, if it were first desired to perforate the zone 22 of FIG. 1, the perforating string 500 would be lowered into the well 10 until the retrievable bridge plug 502 was located below zone 22 with first gun 510 adjacent zone 22, and then the retrievable bridge plug 502 would be set within the casing bore 18 to seal the same. Then actuating fluid pressure in the tubing string 26 is increased and communicated through upper perforated sub 504 to the well annulus 27 and from the well annulus 27 through lower perforated sub 506 to the first firing head 508 to actuate the same. After an appropriate time delay during which the actuating fluid pressure would be bled down, the first firing head 508 will fire the first perforating gun 510 to perforate the first zone 22.

The first perforating gun 51 will have connected to its upper end a component like the crossover sub 82 seen in FIG. 2 which will of course be inverted relative to FIG. 2. The crossover sub 82 will be connected directly to the threads 104 of the second end 122 of a first select fire sub 512 which is generally constructed like the select fire sub 38 of FIG. 3 except it is inverted. The booster 86 of the crossover sub 82 utilized with perforating gun 510 will be directly adjacent the booster 108 of the first select fire sub 512, so that upon firing of the first perforating gun 110, the first select fire sub 512 will also be detonated so as to communicate its lateral bore 142 with its first chamber 124. The lateral bore 142 of first select fire sub 512 is already in open communication with the well annulus 27 so that when the first select fire sub 512 is detonated, it will place its chamber 124 in fluid communication with the surrounding well annulus 27 and thus through a first air chamber 514 will place the well annulus 27 in communication with a second pressure actuated firing head 516.

It is noted that in the system of FIG. 5, there is no need for the isolation device like isolation device 100 seen in FIG. 2, and thus the isolation sub 36 and all components contained therein have been eliminated.

When it is desired to perforate another zone such as the upper zone 20 of FIG. 1, the retrievable bridge plug 502 will be unset from the casing bore and the perforating string 500 will be raised until the bridge plug 502 is located above the previously perforated zone 22 and until a second perforating gun 518 is located adjacent the upper zone 20 which is to be perforated. Then actuating fluid pressure is again applied down through the tubing string 26 and annulus 27 and then through the first select fire sub 512, and first air chamber 514 to the second firing head 516 to fire the second perforating gun 518. The actuating pressure is bled off prior to firing of second gun 518.

In response to firing of the second firing gun 518, a second select fire sub 520 will be detonated thus placing a third firing head 522 in communication with the well annulus 27 through a second air chamber 524.

The next time actuating fluid pressure is raised to the appropriate level, the third firing head 522 will fire third perforating gun 526.

In response to firing of third perforating gun 526, a third select fire sub 528 will be detonated thus providing fluid communication of the well annulus 27 through a third air chamber 530 with a fourth firing head 532 which in turn can fire a fourth perforating gun 534.

Typically, prior to firing of each successive perforating gun, the perforating string 500 will be moved uphole so as to place the retrievable bridge plug 502 above all of the previously existing perforations.

Thus the system of FIG. 5 provides a perforating string 500 which utilizes a retrievable bridge plug and fires a plurality of perforating guns selectively in sequence from the bottom up.

THE EMBODIMENT OF FIG. 6

Still another version of the perforating string of the present invention is shown in FIG. 6 and is generally designated by the numeral 600. The perforating string 600 includes the tubing string 26 and carries a retrievable packer 602 on the lower end of tubing string 26. Located below the retrievable packer 602 is a perforated sub 604 which communicates the inner bore of tubing string 26 with the well annulus 27 surrounding the perforating string 600.

The perforating string 600 of FIG. 6 provides a system which can utilize the retrievable packer 602 to fire a plurality of perforating guns sequentially in series from the top down utilizing the retrievable packer 602 to seal below any perforations which have previously been created.

For example, if it is desired to use the perforating system 600 of FIG. 6 to perforate a plurality of zones such as zones 20 and 22 shown in FIG. i beginning with the upper zone 20, the perforating string 600 is run into the well 10 and the retrievable packer 602 is set in the casing bore 18 above the upper zone 20 which is to be first perforated. The first perforating gun 606 is located adjacent the first zone 20 which is to be perforated.

Actuating fluid pressure from tubing 26 is communicated through the perforated sub 604 to a first pressure actuated firing head 608 which after an appropriate time delay will fire the first perforating gun 606. The actuating fluid pressure will be bled off prior to the time that the first perforating gun 606 fires.

In response to the firing of the first perforating gun 606, a first select fire sub 610 will be detonated thus placing its lateral bore 142 in communication with its first chamber 124. The lateral bore 142 is also in open fluid communication with the well annulus 27.

The retrievable packer 602 is then unset from casing bore 18, and the perforating string 600 is lowered until the packer 602 is located below the previously created perforations and until a second perforating gun 612 is located adjacent the next zone, such as zone 22, which is to be perforated.

Then actuating fluid pressure is again applied to tubing string 26 and thus through perforated sub 604 to the well annulus 27, then in through the first select fire sub 610 and through a first air chamber 614 to a second firing head 616 which after appropriate time delay will fire the second perforating gun 612. The actuating fluid pressure is bled off during the time delay.

In response to firing of the second perforating gun 612, a second select fire sub 618 will be detonated. Then the next time that actuating fluid pressure is applied to tubing string 26, it is communicated through second select fire sub 618 and through a second air chamber 620 to a third firing head 622. Actuating pressure is then bled off. After an appropriate time delay, the third firing head 622 will fire the third perforating gun 624. In response to firing of the third gun 624, a third select fire sub 626 will be detonated.

Then the next time actuating fluid pressure is applied to tubing string 26, it will be communicated through third select fire sub 626 and a third air chamber 628 to a fourth firing head 630 which after an appropriate time delay will fire the fourth perforating gun 632.

After firing of each of the perforating guns, the perforating string 600 will typically be moved downward within the well bore so as to locate the retrievable packer 602 below those perforations which have previously been formed.

Thus the perforating system 600 provides a system which can utilize a retrievable packer to fire a plurality of perforating guns selectively in sequence from the top down, while isolating each zone to be perforated from those zones which have previously been perforated.

THE EMBODIMENT OF FIG. 7

Figure 7:
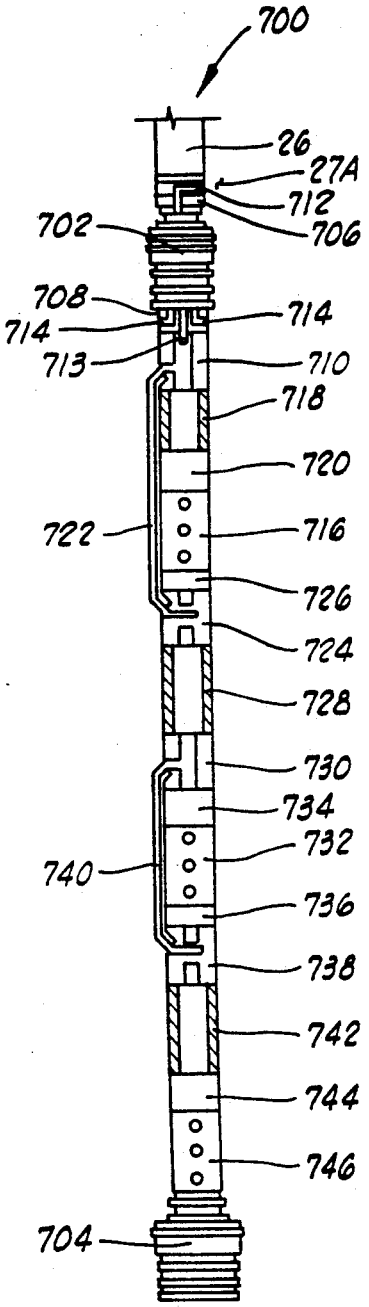
FIG. 7 is an elevation schematic view of a fifth version of the tubing conveyed selective fired perforating system of the present invention. The system of FIG. 7 carries both a packer and a bridge plug and carries a flow test sub so that the various zones which are perforated may be flow tested after perforation. The system of FIG. 7 is constructed to be actuated by fluid pressure conveyed down the well annulus surrounding the tubing string and then crossed over through the upper packer to an external control fluid conduit communicating the series of select fire subs. The system of FIG. 7 is constructed to selectively fire the series of perforating guns in sequence from the top down.

FIG. 7 illustrates another embodiment of the perforating system of the present invention which is shown and generally designated by the numeral 700. The system 700 includes the tubing string 26 previously mentioned. The system 700 of FIG. 7 differs from the systems previously described in that a retrievable upper packer 702 and a retrievable bridge plug or lower packer 704 are carried on the upper and lower ends, respectively, of the tool string so that a zone of the well can be completely isolated between the packer 702 and bridge plug 704 so that after the zone is perforated, it may be flow tested.

The system 700 of FIG. 7 is constructed to fire a plurality of perforating guns selectively in sequence from the top down.

The system 700 also differs from those previously described in that the source of actuating fluid pressure is not the interior of the tubing string 26, but instead is an upper well annulus 27A located above the upper packer 702.

An annulus pressure crossover sub 706 is located above packer 702. A perforated sub 708 which may also be described as a flow test sub 708 is located below packer 702. An upper control line sub 710 is located below flow test sub 708.

The annulus pressure crossover sub 706 communicates fluid pressure from upper well annulus 27A through sub inlet 712 and down through an internal conduit 713 extending through packer 702. The internal conduit 713 is communicated with the inner passage of upper control line sub 710. Thus, control fluid pressure from the upper well annulus 27A is communicated with the upper control line sub 710.

The flow test sub 708 has a plurality of perforations or inlets 714 which are communicated with another internal passage through packer 702 with the inner bore of tubing string 26 so that well fluids may be flowed inward through the inlets 714 of flow test sub 708 and up through the bore of tubing string 26 during a flow test.

To perforate and test the well 10 with the perforating string 700, the operation is carried out in generally the following manner.

For example if it is desired to first perforate the upper zone 20, the perforating string 700 is lowered into the well 10 until the retrievable bridge plug 704 is located below first zone 20 and packer 702 is located above first zone 20 with a first perforating gun 716 located adjacent the zone 20 which is to be perforated. The upper packer 702 and retrievable bridge plug 704 are set within the casing bore 18 so as to isolate the zone 20 which is to be perforated.

Then, actuating fluid pressure is applied to the upper well annulus 27A and is communicated by the annulus pressure crossover sub 706 and through internal conduit 712 with upper control line sub 710 which is communicated through first air chamber 718 with a first pressure actuated firing head 720. After actuation of the first firing head 720, actuating fluid pressure is bled off. After an appropriate time delay, the first gun 716 will fire to perforate the casing adjacent the subsurface zone 20 of interest.

After the first perforating gun 716 is fired, the zone 20 can be flow tested under control of a tester valve (not shown) located within the tubing string 26 to allow flow of well fluids from subsurface formation 20 through the perforations created by perforating gun 716 and in through the inlets 714 of flow test sub 708 and then up through the tubing bore of tubing string 26 to the surface.

The upper control line sub 710 is also communicated with a first control fluid conduit portion 722 which has its lower end connected to a first select fire sub 724. The first select fire sub 724 is arranged identically to the select fire sub 38 shown in FIG. 3 with the first control fluid conduit portion 722 being connected to threaded connection 156 of branch passage 152.

In response to firing of the first perforating gun 716, a first isolation sub 726, which is substantially identical to the isolation sub 36 of FIG. 2, is detonated and in turn detonates the first select fire sub 724 to place the first control fluid conduit portion 722 in fluid communication with a second air chamber 728 and a second control line sub 730.

When it is desired to perforate and test another zone of the well such as the lower formation 22, the packer 702 and retrievable bridge plug 704 are unset from casing bore 18 and the perforating string 70 is moved until the second zone 22 is located between packer 702 and bridge plug 704 with a second perforating gun 732 being located adjacent the second zone 22.

Then actuating fluid pressure is again applied to upper well annulus 27A and is communicated through the annulus pressure crossover sub 706, upper control line sub 710, first control fluid conduit portion 722, first select fire sub 724, second air chamber 728, and second control line sub 730 to a second pressure actuated firing head 734 which in turn will fire the second perforating gun 732. Actuating pressure is bled off before gun 732 fires.

After the second perforating gun 732 is fired to perforate the second zone 22, the second zone 22 can be flow tested through the flow test sub 708.

In response to firing of the second perforating gun 732, a second isolation sub 736 is detonated which in turn detonates a second select fire sub 738, which will place a second control fluid conduit portion 740 in fluid communication through a third air chamber 742 with a third firing head 744 which in turn can selectively actuate a third perforating gun 746.

Thus the perforating string 700 of FIG. 7 provides a system which can selectively isolate, perforate and test multiple zones of a well. The perforating guns of the perforating string 700 are arranged so that they are fired selectively in sequence from the top down.

It will be appreciated that by rearrangement of the perforating guns, select fire subs, isolation subs, and air chambers, a system like that of FIG. 7 operating in response to actuating pressure in the upper well annulus 27A could be constructed to fire its perforating guns from the bottom up.

THE EMBODIMENT Of FIG. 8

FIG. 8 shows another version of the perforating string of the present invention which is generally designated by the numeral 800. The system 800 includes the tubing string 26 previously mentioned.

The perforating string 800 of FIG. 8 carries a retrievable upper packer 802 and a retrievable bridge plug or lower packer 804 on its upper and lower ends as did the system 700 of FIG. 7.

The system 800 is actuated by fluid pressure within the tubing string 26 which is communicated through an inner bore 806 of packer 802 to a perforated sub or flow test sub 808 which communicates the packer bore 806 with the well annulus 27.

The system 800 of FIG. 8 is constructed to fire its plurality of perforating guns selectively in sequence from the bottom up.

A lower perforated sub 810 is connected to the upper end of bridge plug 804 and communicates the well annulus 27 with a first pressure actuated firing head 812. The firing head 812 will, after an appropriate time delay, fire first perforating gun 814.

Located immediately above first perforating gun 814 is a first select fire sub 816 which will be detonated in response to firing of the first gun 814. There is no isolation sub between first gun 14 and first select fire sub 816. The arrangement of the first gun 814 and first select fire sub 816 is similar to that of the first gun 510 and first select fire sub 512 of the system 500 described above with regard to FIG. 5. That is, the first select fire sub 816 is inverted with reference to the arrangement of FIG. 3. Also, the lateral bore 142 of first select fire sub 816 is in open communication with the well annulus 27.

Detonation of the first select fire sub 816 will place the well annulus 27 in communication through a first air chamber 818 with a second pressure actuated firing head 820.

After the first perforating gun 814 is fired to perforate a first zone of the well, the well can be flow tested by flowing well fluids in through the flow test sub 808 and up the bore of tubing string 26.

When it is desired to perforate and test another zone of the well, the packer 802 and bridge plug 804 are unset, and the test string 800 is moved until a second zone of interest is located between the packer 802 and bridge plug 804 with a second perforating gun 822 located adjacent the second zone of interest. Then fluid actuating pressure is again applied to tubing string 26 and communicated through the first select fire sub 816 and first air chamber 818 to the second firing head 820 to actuate the same. After an appropriate time delay during which actuating fluid pressure is bled off, the second perforating gun 822 will fire thus perforating the second zone of interest which can then be flow tested.

In response to firing of the second perforating gun 822, a second select fire sub 824 is detonated to place the well annulus 27 in communication through an air chamber 826 with a third pressure actuated firing head 828 which can in turn fire a third perforating gun 830.

Thus the perforating string 800 provides a system which is actuated in response to tubing pressure and which can isolate, perforate and test selective zones, with the perforating guns being fired selectively in sequence from the bottom up. It will be appreciated that by rearrangement of the perforating guns, select fire subs and air chambers, that a system like that of FIG. 8 operating on tubing fluid pressure 26 could be constructed to fire its guns from the top down.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. A system for selectively perforating multiple zones in a well on a single trip into said well, comprising:

a tubing string;

at least a first and a second perforating gun carried by said tubing string;

at least a first and a second pressure actuated firing head associated with said first and second perforating guns, respectively;

a source of actuating fluid pressure for said firing heads;

a first selective communication means for isolating said second firing head from source of actuating fluid pressure until after said first perforating gun has been fired and for then communicating said second firing head with said source of actuating fluid pressure in response to firing of said first perforating gun.

2. The system of claim 1, further comprising:

a total number X of said perforating guns including said first and second perforating guns, X being an integer at least equal to 2;

a total number X of said pressure actuated firing heads including said first and second firing heads; and a total number X−1 of said selective communication means including said first selective communication means.

3. The system of claim 1, wherein:

said first selective communication means includes a select fire sub including:

a housing having a first chamber defined therein communicated with said second firing head;

a supply passage communicated with said source of actuating fluid pressure and extending into said housing, said supply passage initially being isolated from said first chamber; and explosive means for perforating a portion of said housing and thereby communicating said supply passage with said first chamber.

4. The system of claim 3, wherein:

said housing of said select fire sub has a second chamber defined therein in addition to said first chamber, said chambers being initially separated by a wall; and said explosive means is disposed in said second chamber and is a means for perforating said wall.

5. The system of claim 4, wherein:

said supply passage extends into said wall, said wall being said portion of said housing perforated by said explosive means to communicate said supply passage with said first chamber.

6. The system of claim 3, further comprising:

actuating means for firing said explosive means of said select fire sub in response to firing of said first perforating gun.

7. The system of claim 6, further comprising:

isolation means for isolating said first perforating gun from said first chamber of said select fire sub after said explosive means of said select fire sub is fired.

8. The system of claim 7, wherein:

said actuating means and said isolation means are contained in an isolation sub having one end attached to said select fire sub and having another end attached to said first perforating gun.

9. The system of claim 7, wherein:

said source of actuating fluid pressure includes a control fluid conduit connected to said supply passage.

10. The system of claim 3, wherein:

said source of actuating fluid pressure includes a well annulus surrounding said select fire sub, said supply passage being open to said well annulus; and said select fire sub is constructed so that when said explosive means perforates said portion of said housing, said first chamber is communicated with said well annulus.

11. The system of claim 1, wherein:

said first perforating gun is located below said second perforating gun so that said system fires said perforating guns sequentially from the bottom up.

12. The system of claim 1, wherein:

said first perforating gun is located above said second perforating gun so that said system fires said perforating guns sequentially from the top down.

13. The system of claim 1, wherein:

said source of actuating fluid pressure includes a well annulus surrounding said first selective communication means;

said system further includes a bridge plug carried by said tubing string below said perforating guns; and said first perforating gun is located below said second perforating gun so that said system fires said perforating guns sequentially from the bottom up.

14. The system of claim 1, wherein:

said source of actuating fluid pressure includes a well annulus surrounding said first selective communication means;

said system further includes a packer carried by said tubing string above said perforating guns; and said first perforating gun is located above said second perforating gun so that said system fires said perforating guns sequentially from the top down.

15. The system of claim 1, further comprising an upper packer carried by said tubing string above said perforating guns;

a lower packer carried by said tubing string below said perforating guns; and a flow test sub communicating a well annulus surrounding said perforating guns with an inner bore of said tubing string so that a subsurface zone perforated by one of said perforating guns can be flow tested.

16. The system of claim 1, wherein:

said first firing head provides a time delay prior to firing said first perforating gun, so that actuating fluid pressure may be bled off after actuating said first firing head and before firing said first perforating gun.

17. A select fire sub apparatus, comprising:

a cylindrical housing having first and second ends;

said housing having first and second axially extending chambers defined therein communicated with said first and second ends, respectively, and extending axially inward toward each other, said first and second chambers terminating in blind ends separated by a wall of said housing;

said housing having an actuating pressure supply passage defined therein and extending laterally into said wall between said blind ends of said first and second chambers;

said first end of said housing including means for communicating said first chamber with a pressure responsive firing head associated with a perforating gun; and said second chamber including means for receiving an explosive charge for perforating said wall of said housing and thereby communicating said pressure supply passage with said first chamber.

18. The apparatus of claim 17, wherein said actuating fluid supply passage comprises:

a lateral bore;

first and second recesses defined in an outer cylindrical surface of said housing on opposite sides longitudinally of said lateral bore; and first and second branch passages communicating said lateral bore with said first and second recesses, respectively, each of said branch passages including means for connection thereof to a control fluid conduit extending into said recesses.

19. A method of perforating multiple zones in a well, comprising:

(a) running into said well a tubing conveyed multiple zone perforating string including:

a tubing string;

at least a first and a second perforating gun carried by said tubing string; and at least a first and a second pressure actuated firing head associated with said first and second perforating guns, respectively;

(b) applying actuating fluid pressure from a source of actuating fluid pressure to said first firing head;

(c) isolating said second firing head from said source of said actuating fluid pressure during step (b);

(d) after step (b), firing said first perforating gun and;

(e) in response to firing said first perforating gun in step (d), communicating said second firing head with said source of said actuating fluid pressure.

20. The method of claim 19, further comprising:

between steps (b) and (d), bleeding off said actuating fluid pressure.

21. The method of claim 20, further comprising:

during step (e), isolating said second firing head from said first perforating gun.

22. The method of claim 20, further comprising:

applying actuating fluid pressure to said second firing head; and firing said second perforating gun.

23. The method of claim 22, further comprising:

firing said perforating guns sequentially from the bottom up, said first perforating gun being located below said second perforating gun.

24. The method of claim 22, further comprising:

firing said perforating guns sequentially from the top down, said first perforating gun being located above said second perforating gun.

25. The method of claim 20, wherein:

step (c) includes isolating said second firing head from said source of actuating fluid pressure with a wall; and step (e) includes detonating an explosive charge to perforate said wall and thereby communicate said second firing head with said source of actuating fluid pressure.

26. The method of claim 20, further comprising:

flow testing a subsurface zone perforated by said first perforating gun.

27. The method of claim 26, further comprising:

prior to step (d), isolating said subsurface zone between upper and lower packer elements carried by said tubing string.

* * * * *